US006267071B1

(12) United States Patent
Ellis

(10) Patent No.: US 6,267,071 B1
(45) Date of Patent: Jul. 31, 2001

(54) ADJUSTABLE HELM SEAT AND ACTUATING APPARATUS OF SAME

(76) Inventor: Donald Ray Ellis, HC33, Box 239, Seal Cove, ME (US) 04674

( * ) Notice: Subject to any disclaimer, the term of this patent is extended or adjusted under 35 U.S.C. 154(b) by 0 days.

(21) Appl. No.: 09/544,559

(22) Filed: Apr. 6, 2000

(51) Int. Cl.[7] ..... B63B 17/00
(52) U.S. Cl. ..... 114/363
(58) Field of Search ..... 114/363

(56) References Cited

U.S. PATENT DOCUMENTS 3,188,044 * 6/1965 Epple ..... 248/419
3,428,976 * 2/1969 Robinson ..... 114/363
4,399,570 * 8/1983 Tracy et al. ..... 4/561.1
4,425,863 * 1/1984 Cutler ..... 114/363
4,766,838 * 8/1988 Johnson ..... 114/363
4,844,543 * 7/1989 Ochiai ..... 297/344.26
5,105,756 * 4/1992 Bell ..... 114/363
5,161,765 * 11/1992 Wilson ..... 248/425
5,463,972 * 11/1995 Gezari et al. ..... 114/363
5,522,641 * 6/1996 Infanti ..... 297/344.13
5,746,465 * 5/1998 Jones et al. ..... 296/65.03
5,810,125 * 9/1998 Gezari ..... 188/266.2
6,042,145 * 3/2000 Mitschelen ..... 280/735

* cited by examiner

*Primary Examiner*—S. Joseph Morano
*Assistant Examiner*—Andrew Wright
(74) *Attorney, Agent, or Firm*—Thomas L. Bohan; Patricia M. Mathers

(57) ABSTRACT

An apparatus for providing vertical and horizontal adjustment of a helm seat in the cockpit of a boat. The apparatus can be mounted on a wall of the cockpit, without requiring any floor-based support, thereby providing better access to the floor area beneath the seat.

7 Claims, 2 Drawing Sheets

ADJUSTABLE HELM SEAT AND ACTUATING APPARATUS OF SAME

BACKGROUND INFORMATION

1. Field of the Invention

The present invention relates to the field of seats at the helm of a boat. More particularly, the present invention relates to a helm seat adjustment assembly that permits the helm seats to be adjustable vertically and horizontally. Most particularly yet, the present invention relates to such an adjustment assembly and to a control device for actuating the same.

2. Description of the Prior Art

The helm of a boat is the steering and control center of the boat and is situated in the boat cockpit. It typically comprises a steering wheel, engine throttle controls and the visual instruments that display speed, engine operating conditions, water depth, and radar and other navigation data. The term boat as used herein refers to an engine- and/or wind-propelled water craft, controlled by a human operator. For the purposes of this discussion, no distinction is made between work boats and pleasure boats.

The operational parameters of a boat constantly change while it is underway, primarily due to chances in boat speed, and/or wind and wave conditions. As boat speed increases, for example, the angle of the boat relative to the water surface also changes. It is critical for operational safety that the boat operator maintain a proper position relative to the helm, and that his or her view around the exterior of the boat be clear. Thus, the changing parameters frequently require that the boat operator change his or her position within the boat in order to maintain optimal seating position relative to the helm and to maintain the clear line-of-sight that is vital to safe operation of the boat.

Apart from the variable boating conditions, the variation in physical size from one boat operator to the next also makes desirable a helm seat that can be adjusted. Conventional helm seats are mounted on the floor of the boat in the cockpit by a vertical pier or the like. In addition to being difficult to adjust, such floor-mounted helm seats have the further disadvantage that they take up valuable floor space and make it difficult to access hatches that need to be opened to reach equipment or storage areas beneath the floor in the vicinity of the helm. Also, floor-mounted helm seats make it difficult to clean and/or maintain the cockpit area.

Therefore, what is needed is a method of, and apparatus for, providing a helm seat that will readily and comfortably accommodate the necessary position changes of the boat operator during navigation. What is further needed is such a method and apparatus that will improve the utilization of space and simplify cleaning and maintenance tasks in the cockpit.

SUMMARY OF THE INVENTION

For the reasons cited above, it is an object of the invention to provide a method of mounting a helm seat that readily and comfortably allows the boat operator to adjust his or her seated position at the helm, vertically and/or horizontally. It is a further object of the invention to provide such a method that will improve the utilization of floor space beneath the helm seat and simplify cleaning and maintenance tasks in the cockpit. It is a yet further object to provide a vertical and horizontal position-adjustment apparatus according to the method.

The objects of the invention are achieved by providing a method of controlling and modifying the vertical and horizontal position of a helm seat mounted to a cockpit wall of the boat cockpit. Further, the objects are achieved by providing apparatus for adjusting the vertical and/or horizontal position of a helm seat according to the method, and a control device for controlling and modifying the horizontal and vertical position of the helm seat.

The goal of providing improved access to that area of the boat deck under the helm seat is met by providing a cantilevered mount for the seat. An adjustable helm seat according to the present invention has a vertical-adjustment assembly that includes a pair of vertical rails. The vertical-adjustment assembly is rigidly affixed to a wall of a boat cockpit by conventional means, such as bolts or other threaded fasteners or rivets. A vertically adjustable helm-seat frame component is slidably arranged between the pair of vertical rails. The helm seat further has a horizontal-adjustment assembly that includes a pair of horizontal rails and a horizontal-adjustment actuating device is affixed to the vertically adjustable seat frame component. The vertical adjustment and horizontal adjustment may be manually, electrically, pneumatically, or hydraulically controlled, such as by a mechanical crank mechanism, or conventional electrical or hydraulic control means. A position-control device that, in the Preferred Embodiment, connects and activates both the horizontal adjustment and the vertical adjustment, is provided in a location that is readily accessible to the boat operator.

DETAILED DESCRIPTION OF THE PREFERRED EMBODIMENT

Figure 1:
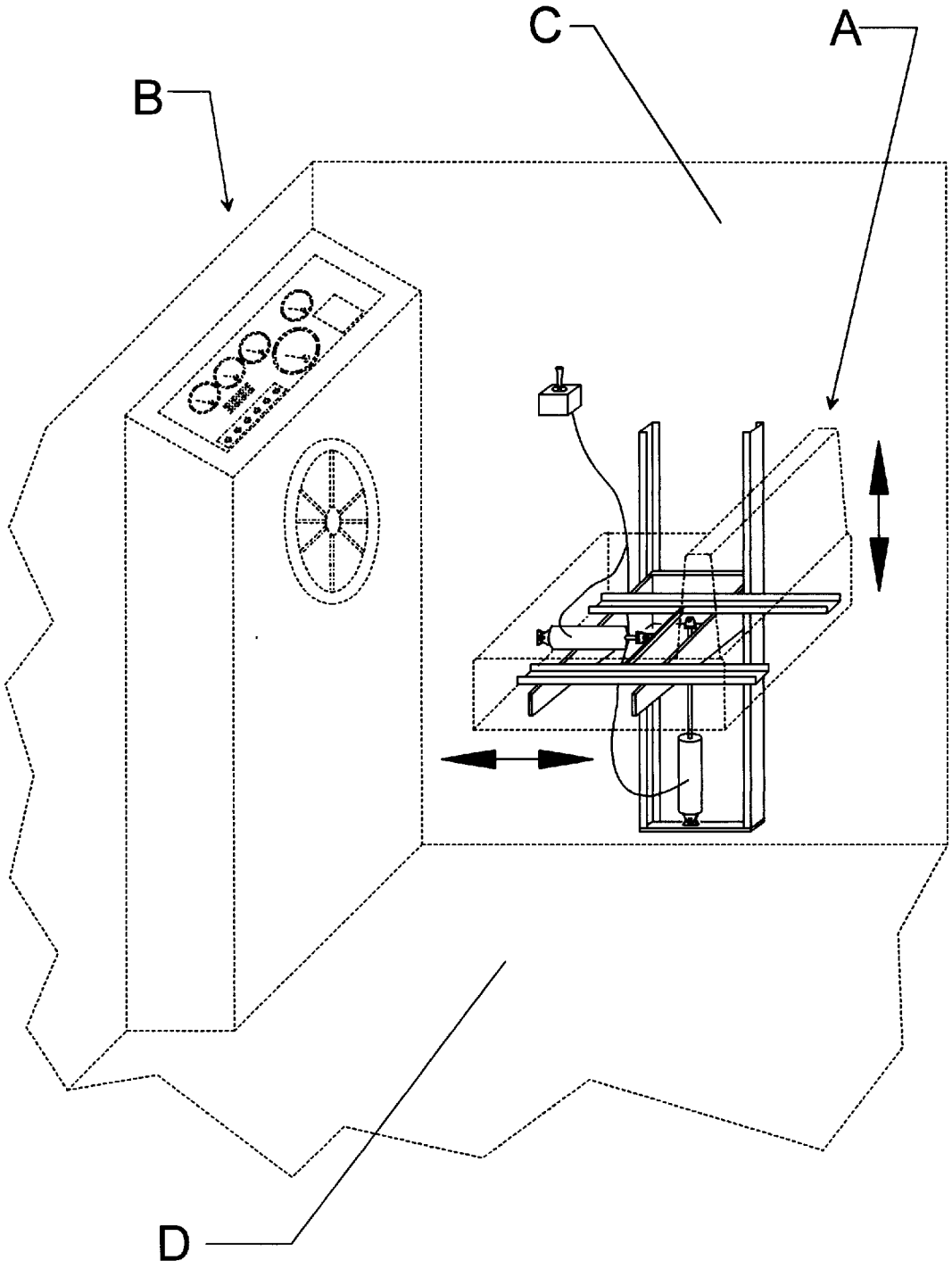
FIG. 1. An adjustable helm seat according to the Preferred Embodiment of the present invention, shown in its usual position, rigidly affixed to a cockpit wall, above the cockpit floor, and in close proximity to the helm.
Figure 2:
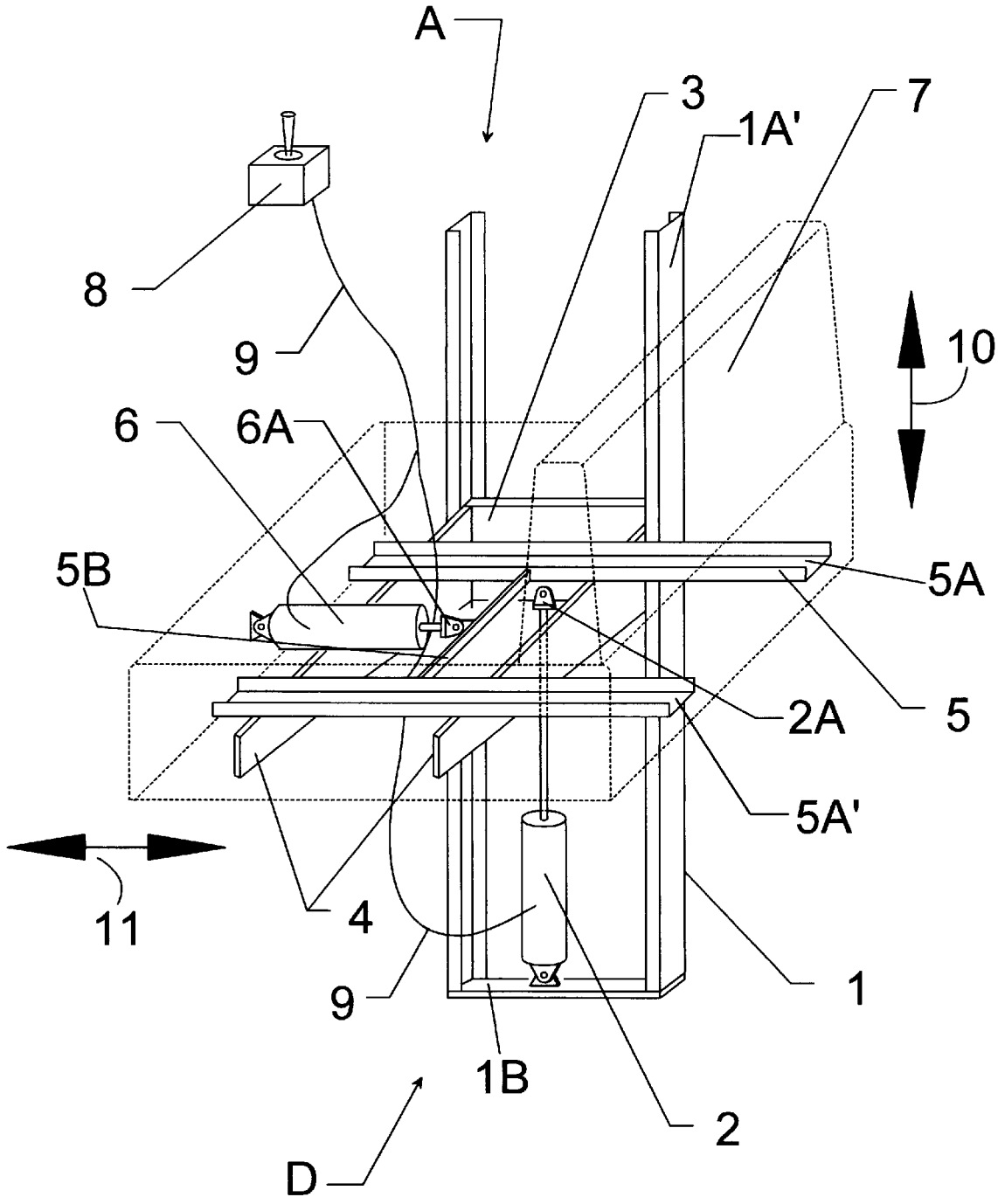
FIG. 2. A close-up view of the apparatus of FIG. 1.

FIG. 1 shows a typical position for a helm seat A according to the Preferred Embodiment of the present invention. The helm seat A is situated in front of a helm B that includes a steering wheel and an arrangement of navigational aids and controls. The helm seat A is attached to a cockpit wall C by means of a helm-seat mount assembly D. FIG. 2 shows a detailed view of the helm-seat-assembly D, which includes a vertical-adjustment assembly 1 having two rails—a left vertical rail 1A and a right vertical rail 1A'—that extend substantially parallel to each other, and a vertical-adjustment assembly crossbar 1B that connects the left and right vertical rails 1A, 1A'. It is the vertical adjustment assembly 1 that is rigidly affixed to the cockpit wall C (not shown in FIG. 2). A seat-frame slide 3, from which two cantilevered arms 4 extend, is slidably arranged between the left vertical and right vertical rails 1A, 1A'. A horizontal-adjustment assembly 5 comprising two horizontal rails—a first horizontal rail 5A and a second horizontal rail 5A'—and a horizontal-adjustment-assembly crossbar 5B is arranged on the cantilevered arms 4. In the Preferred Embodiment shown, a sliding seat 7 is arranged on the horizontal-adjustment assembly 5.

A first actuator 2 is mounted on the vertical-adjustment assembly crossbar 1B, and its operating (extendable) end 2A is connected via a control cable 9 to a position-control device 8. The first actuator 2, which in the Preferred Embodiment is a hydraulic piston and rod device, is connected to the seat-frame slide 3, allowing the first actuator 2 to slidably displace the seat-frame slide 3 upward or downward as indicated by up/down arrow 10, depending on a signal from the position-control device 8 that is operable by a boat operator. A second actuator 6 is connected at its operating (extendable) end 6A to the horizontal-adjustment-assembly crossbar 5B and is also connected to the position-control device 8. The second actuator 6, again depending on the signal from the position-control device 8, can slidably displace the seat horizontally in the longitudinal direction of the boat, as indicated by forward/back arrow 11.

It should be understood that the Preferred Embodiment mentioned herein is merely illustrative of the present invention. Numerous variations in construction and use of the present invention may be contemplated in view of the following claims without straying from the intended scope and field of the invention herein disclosed.

What is claimed is:

1. Apparatus for the vertical and horizontal adjustment of a helm seat situated in a cockpit of a boat, wherein said boat has a floor and a longitudinal axis and said cockpit has a steering means and at least one cockpit wall, said apparatus comprising:

a linear helm seat adjustment assembly; and a position-control device;

wherein said helm seat-adjustment assembly is fixedly mountable on said cockpit wall of said boat, without a support that extends between said adjustment assembly and said floor of said boat, wherein said linear helm seat adjustment assembly includes a linear vertical-adjustment assembly and a linear horizontal-adjustment assembly and wherein a helm seat mounted on said linear helm seat adjustment assembly is horizontally adjustable along said horizontal seat axis that extends substantially parallel to a longitudinal axis of said boat so as to maintain said helm seat aligned with said steering means, and is vertically adjustable, and wherein said vertical-adjustment assembly and said horizontal-adjustment assembly are independently adjustable by said position-control device.

2. The apparatus of claim 1, wherein said vertical-adjustment assembly includes a left vertical rail and a right vertical rail that extend parallel to each other and are connected to each other by a vertical-adjustment-assembly crossbar that extends between and substantially perpendicularly to said left and right vertical rails, and a seat frame having a seat-frame slide and two cantilevered seat-frame sides, wherein said seat-frame slide is slidably mounted between said left and right vertical rails and said cantilevered seat-frame sides extend parallel to each other from said seat-frame slide, and wherein said vertical-adjustment assembly is fixedly attachable to said cockpit wall.

3. The apparatus of claim 2, wherein said horizontal-adjustment assembly includes a first horizontal rail and a second horizontal rail that extend parallel to each other and are connected to each other by a horizontal-adjustment-assembly crossbar that extends between and substantially perpendicularly to said first and second horizontal rails.

4. The apparatus of claim 3, wherein said horizontal-adjustment assembly is mounted on said vertical-adjustment assembly.

5. The apparatus of claim 2 further comprising a first actuating device that is mounted on said vertical-adjustment assembly and a second actuating device that is mounted on said horizontal-adjustment assembly, a first connection cable connecting said position-control device to said first actuating device, and a second connection cable connecting said position-control device to said second actuating device.

6. The apparatus of claim 5, wherein said first actuating device and said second actuating device are selected from the group consisting of mechanically, electrically, pneumatically, and hydraulically operated actuators.

7. The apparatus of claim 5, wherein said position-control device includes a first position-control device that is allocated to said vertical adjustment assembly and a second position-control device that is allocated to said horizontal adjustment assembly, and wherein said first connection cable connects said first position-control device to said first actuating device and said second connection cable connects said second position-control device to said second actuating device.

* * * * *